US010553185B2

(12) United States Patent
Chen

(10) Patent No.: US 10,553,185 B2
(45) Date of Patent: Feb. 4, 2020

(54) DRIVING CIRCUIT AND METHOD OF DISPLAY PANEL AND DISPLAY DEVICE

(71) Applicants: HKC CORPORATION LIMITED, Shenzhen (CN); CHONGQING HKC OPTOELECTRONICS TECHNOLOGY CO., LTD., Jieshi, Banan District (CN)

(72) Inventor: Yu-jen Chen, Jieshi (CN)

(73) Assignees: HKC Corporation Limited, Shenzhen, Guangdong (CN); Chongqing HKC Optoelectronics Technology Co., Ltd., Jeshi, Chongqing (CN)

( * ) Notice: Subject to any disclaimer, the term of this patent is extended or adjusted under 35 U.S.C. 154(b) by 165 days.

(21) Appl. No.: 15/744,203

(22) PCT Filed: Aug. 31, 2017

(86) PCT No.: PCT/CN2017/100032

§ 371 (c)(1),
(2) Date: Jan. 12, 2018

(87) PCT Pub. No.: WO2018/233053

PCT Pub. Date: Dec. 27, 2018

(65) Prior Publication Data

US 2019/0005925 A1 Jan. 3, 2019

(30) Foreign Application Priority Data

Jun. 20, 2017 (CN) ..... 2017 1 0470447

(51) Int. Cl.
*G09G 5/395* (2006.01)
*G09G 3/20* (2006.01)
*G09G 3/36* (2006.01)

(52) U.S. Cl.
CPC ..... *G09G 5/395* (2013.01); *G09G 3/20* (2013.01); *G09G 3/2096* (2013.01); (Continued)

(58) Field of Classification Search
None
See application file for complete search history.

(56) References Cited

U.S. PATENT DOCUMENTS

2008/0224980 A1* 9/2008 Senda ..... G09G 3/3648 345/96
2010/0171688 A1* 7/2010 Wang ..... G09G 3/3611 345/99

(Continued)

FOREIGN PATENT DOCUMENTS

CN 1672188 9/2005
CN 101599256 A 12/2009

(Continued)

OTHER PUBLICATIONS

International Search Report and Written Opinion Form PCT/ISA/210 and PCT/ISA/237, International Application No. PCT/CN2017/100032, pp. 1-8, International Filing Date Aug. 31, 2017, dated Mar. 28, 2018.
Non-translated Chinese Office Action dated Feb. 1, 2019, pp. 1-5.

*Primary Examiner* — Parul H Gupta
(74) *Attorney, Agent, or Firm* — Bond Schoeneck & King, PLLC; George McGuire

(57) ABSTRACT

Provided are a driving circuit and driving method of a display panel and a display device. A drive voltage signal converted from an Nth-row data of current-frame data is inverted into an Nth-row data of previous-frame data relative to next-frame data and the Nth-row data of previous-frame data relative to next-frame data is cached, so that the Nth-row data of previous-frame data can be cached without using a double-data-rate synchronous dynamic random access memory.

17 Claims, 4 Drawing Sheets

(52) U.S. Cl.
CPC ..... *G09G 3/3688* (2013.01); *G09G 2310/027* (2013.01); *G09G 2310/0289* (2013.01); *G09G 2310/0291* (2013.01); *G09G 2310/0297* (2013.01); *G09G 2310/08* (2013.01); *G09G 2320/0252* (2013.01); *G09G 2320/0285* (2013.01); *G09G 2340/02* (2013.01); *G09G 2340/16* (2013.01); *G09G 2360/121* (2013.01); *G09G 2360/18* (2013.01)

(56) References Cited

U.S. PATENT DOCUMENTS

| | | | | |
|---|---|---|---|---|
| 2011/0025680 | A1* | 2/2011 | Kim | G09G 3/3648 345/214 |
| 2015/0211760 | A1* | 7/2015 | Wang | F24F 11/30 700/276 |

FOREIGN PATENT DOCUMENTS

| | | |
|---|---|---|
| CN | 103151015 | 6/2013 |
| CN | 104916264 | 9/2015 |
| CN | 107045862 | 8/2017 |
| TW | 413976 | 11/2013 |

* cited by examiner

DRIVING CIRCUIT AND METHOD OF DISPLAY PANEL AND DISPLAY DEVICE

CROSS-REFERENCE TO RELATED APPLICATIONS

This application is the United States National Phase Entry of PCT Application No. PCT/CN2017/100032 filed on Aug. 31, 2017, which claims priority to Chinese patent application No. 201710470447.9, filed on Jun. 20, 2017, the entire disclosure of each of which is incorporated herein by reference.

TECHNICAL FIELD

The present disclosure relates to the field of display techniques and, in particular, to a driving circuit and driving method of a display panel and a display device.

BACKGROUND

With the continuous development of display techniques, display apparatuses including liquid crystal display panels and display screens have been developing towards light and thin designs, large screens, low power consumption and low costs. Panels with a large viewing angle produce good visual effects and overcome a problem that it is impossible to normally watch an image through an ordinary display panel from a side or at a large visual angle, and therefore have been widely used and have become a trend in the development of display panels. At present, timer control registers (TCONs) of panels with a large viewing angle typically employ the liquid crystal over driving (OD) technology to improve the response speed.

However, when using the liquid crystal over driving technology, usually a double-data-rate (DDR) synchronous dynamic random access memory and a corresponding DDR control module are employed to store drive data of a previous frame configured to drive the panel to display so as to achieve liquid crystal over driving, severely increasing the manufacturing cost of the timer control registers.

SUMMARY

The present disclosure provides a driving circuit and method of a display panel and a display device intended to solve a serious manufacturing cost problem of the timer control registers using the double-data-rate (DDR) synchronous dynamic random access memory and corresponding DDR control module to implement liquid crystal over driving.

Embodiments of the present disclosure provide a driving circuit of a display panel, including: a current-frame Nth-row data buffer module, a previous-frame Nth-row data buffer module, an over driving module, a source driver module, a switch module and a signal inverter module.

The current-frame Nth-row data buffer module is configured to, upon receiving an Nth-row data of current-frame data for driving an Nth-row of pixels in the display panel, cache the Nth-row data of current-frame data, wherein N is a positive integer greater than or equal to 1.

The previous-frame Nth-row data buffer module is configured to cache an Nth-row data of previous-frame data for driving the Nth-row of pixels when the Nth-row data of current-frame data is cached.

The over driving module is connected to the previous-frame Nth-row data buffer module and the current-frame Nth-row data buffer module and configured to read the Nth-row data of current-frame data and the Nth-row data of previous-frame data and to search a pre-stored data lookup table for a drive data corresponding to the Nth-row data of current-frame data and the Nth-row data of previous-frame data.

The source driver module is connected to the over driving module and configured to obtain a first drive voltage signal and a second drive voltage signal identical to the first drive voltage signal based on the drive data.

The switch module is connected to the source driver module and the display panel separately and configured to be turned on when receiving the first level signal and be turned off when receiving the second level signal and, when be turned off, to output the first drive voltage signal to the display panel so as to drive the display panel to display.

The signal inverter module is connected to the switch module, wherein when the switch module is turned on, the signal inverter module is configured to be connected to the source driver module, invert the second drive voltage signal and store the inverted second drive voltage signal in the previous-frame Nth-row data buffer module, and wherein when the switch module is turned off, the signal inverter module is further configured to be disconnected from the source driver module.

Embodiment of the present disclosure provide a driving method of a display panel. The method includes:

driving method of a display panel upon receiving an Nth-row data of current-frame data for driving an Nth-row of pixels in the display panel, caching the Nth-row data of current-frame data, wherein N is a positive integer greater than or equal to 1:

caching an Nth-row data of previous-frame data for driving the Nth-row of pixels, when the Nth-row data of current-frame data is cached:

reading the Nth-row data of current-frame data and the Nth-row data of previous-frame data, searching a pre-stored data lookup table for a drive data corresponding to the Nth-row data of current-frame data and the Nth-row data of previous-frame data, and outputting the drive data:

processing the drive data into a first drive voltage signal and a second drive voltage signal identical to the first drive voltage signal:

upon receiving a first level signal, outputting the first drive voltage signal to the display panel so as to drive the display panel to display; and upon receiving a second level signal, inverting the second drive voltage signal into an Nth-row data of previous-frame data relative to next-frame data and caching the Nth-row data of previous-frame data relative to next-frame data.

Embodiment of the present disclosure provide a display device including a display panel and a control unit. The control unit includes the above driving circuit.

In embodiments of the present disclosure, a drive voltage signal converted from an Nth-row of current-frame data is inverted into an Nth-row of previous-frame data relative to next-frame data and the Nth-row of previous-frame data relative to next-frame data is cached, so that the Nth-row of previous-frame data is cached without using a DDR and thus actual drive data is searched in a table based on the Nth-row of current-frame data and the Nth-row of previous-frame data and LCD over driving is achieved, effectively reducing TCON manufacturing costs.

BRIEF DESCRIPTION OF DRAWINGS

To illustrate solutions in embodiments of the present disclosure more clearly, the accompanying drawings used in description of the embodiments will be described below. Apparently, the accompanying drawings described below illustrate part of embodiments of the present disclosure, and those skilled in the art may obtain other accompanying drawings based on the accompanying drawings described below on the premise that no creative work is done.

DETAILED DESCRIPTION

The solutions of the present disclosure are described hereinafter through specific embodiments in conjunction with the accompanying drawings. The embodiments set forth below are intended to illustrate and not to limit the present disclosure. It is to be noted that to facilitate description, only part, not all, of structures related to the present disclosure are illustrated in the accompanying drawings. The following embodiments and the features thereof may be combined with each other, as long as they do not conflict with each other.

For a better understanding of the solution of the present disclosure, the solutions in embodiments of the present disclosure will be described clearly and completely in connection with the accompanying drawings in embodiments of the present disclosure. Apparently, embodiments described below are part, not all, of embodiments of the present disclosure. Based on the embodiments described herein, all other embodiments obtained by those skilled in the art without creative work are within the scope of the present disclosure.

The terms "comprising", "including" or any other variations thereof in the specification, claims and accompanying drawings of the present disclosure are intended to cover a non-exclusive inclusion. For example, a process, method, system, product or device that includes a series of steps or elements not only includes the listed steps or elements but may further optionally include steps or elements that are not listed or inherent to such process, method, system, product or device. In addition, the terms like "first", "second" and "third" are configured to distinguish different objects rather than describe a particular sequence.

Figure 1:
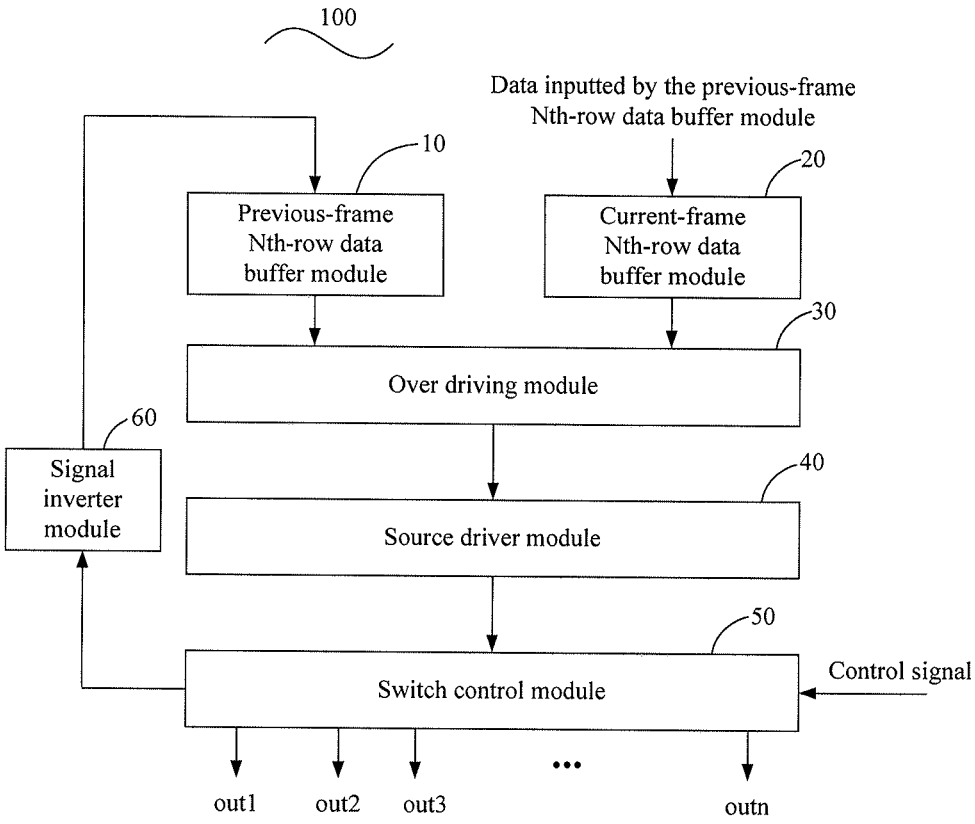
FIG. 1 is a schematic diagram of a driving circuit of a display panel driving circuit according to an embodiment of the present disclosure.

As illustrated in FIG. 1, an embodiment of the present disclosure provides a driving circuit of a display panel 100 including a previous-frame Nth-row data buffer module 10, a current-frame Nth-row data buffer module 20, an over driving module 30, a source driver module 40, a switch module 50 and a signal inverter module 60.

The current-frame Nth-row data buffer module 20 is configured to, when receiving Nth-row data of current-frame data, cache the Nth-row data of current-frame data. The Nth-row data of current-frame data is used for driving the Nth-row of pixels in the display panel, where N is a positive integer greater than or equal to 1.

The Nth-row data of current-frame data is inputted in a current-frame scanning period and is used for driving the Nth-row of pixels in the display panel. A frame of data for driving all pixels in the display panel is inputted in one frame scanning period. One frame of data includes data in several rows. The number of the rows is equal to the number of the rows of the pixels. Each row data drives one corresponding row of pixels. The current-frame Nth-row data buffer module 20 is connected to an external timer/counter control register (TCON). The current-frame Nth-row data buffer module 20 is configured to write one row data of current-frame data at a rising edge of an output signal of the external timer/counter control register.

In the present embodiment, the current-frame Nth-row data buffer module 20 may be a buffer or another memory unit having an equal buffer memory function, which is not particularly limited in the present embodiment.

The previous-frame Nth-row data buffer module 10 is configured to, when the Nth-row data of current-frame data is cached, cache the Nth-row data of previous-frame data for driving the Nth-row of pixels.

The Nth-row data of previous-frame data is inputted in a previous-frame scanning period and is used for driving the Nth-row of pixels in the display panel.

In the present embodiment, the previous-frame Nth-row data buffer module 10 may be a buffer or another memory unit having an equal buffer memory function, which is not particularly limited in the present embodiment.

The over driving module 30 is connected to the previous-frame Nth-row data buffer module 10 and the current-frame Nth-row data buffer module 20 and is configured to read the Nth-row data of current-frame data and the Nth-row data of previous-frame data, search a pre-stored data lookup table for drive data corresponding to the Nth-row data of current-frame data and the Nth-row data of previous-frame data and to output the drive data.

By comparing the Nth-row data of current-frame data and the Nth-row data of previous-frame data, the over driving module 30 searches the pre-stored data lookup table for a data corresponding to the Nth-row data of current-frame data and the Nth-row data of previous-frame data. The data is used for driving the display panel, and a drive value of the data is greater than or less than a drive value of the current row data. The drive value is proportional to a value of a drive voltage for driving the display panel and is also proportional to a gray-scale value of the display panel.

In the present embodiment, the data lookup table records drive data corresponding to each row of current-frame data and previous-frame data. For example, when the ith-row data of previous-frame data is 16 and the ith-row data of current-frame data is 48, the corresponding drive data found in the data lookup table is 53 that is greater than 48 (the ith-row data of current-frame data); when the jth-row data of previous-frame data is 144 and the jth-row data of current-frame data is 32, the corresponding drive data found in the data lookup table is 13 that is less than the jth-row data of current-frame data.

In the present embodiment, the over driving module 30 may be a liquid crystal over driving controller (ODC) having a liquid crystal over driving function implemented based on the liquid crystal over driving technology or may be a device having an equal data lookup and output function. The specific implementation is not particularly limited in the present embodiment. The over driving module 30 of the present disclosure does not include a double-data-rate (DDR) synchronous dynamic random access memory.

The source driver module 40 is connected to the over driving module 30 and is configured to obtain a first drive voltage signal and a second drive voltage signal identical to the first drive voltage signal based on the drive data. In the present embodiment, the drive data is a digital signal, and the first drive voltage signal and the second drive voltage signal are analog signals. The source driver module 40 includes, e.g., a digital-to-analog converter (DAC).

The first drive voltage signal and the second drive voltage signal are analog voltage signals corresponding to the drive data. The second drive voltage signal is a duplication of the first drive voltage signal. A digital signal inverted from the second drive voltage signal by the signal inverter module serves as an Nth-row data of previous-frame data relative to next-frame data.

In the present embodiment, the source driver module may be a source driver IC or other components or circuits having an equal source drive function, which is not particularly limited in the present embodiment.

The switch module 50 is connected to the source driver module 40 and the display panel (not illustrated) and is configured to be turned on when receiving a first level signal and turned off when receiving a second level signal and, when turned off, to output the first drive voltage signal to the display panel so as to drive the display panel to display.

The display panel typically includes multiple columns of pixel units that need to be driven and scanned, and thus the drive voltage signal outputted to the display panel actually includes multiple output signals. By way of example, FIG. 1 illustrates n output signals including out1, out2, out3, . . . , outn. n is a positive integer greater than 1.

In the present embodiment, the switch module 50 may be an electronic switch such as a Metal Oxide Semiconductor Field Effect Transistor and a triode.

The first level signal may be a high level signal and is configured to turn on the switch module, and the second level signal may be a low level signal and is configured to turn off the switch module. Similarly, the switch module may be turned off by a high level and turned on by a low level. Accordingly, the first level signal is a low level signal and the second level signal is a high level signal.

The signal inverter module 60 is connected to the switch module 50. The signal inverter module 60 is configured, when the switch module 50 is turned on, to be connected to the source driver module 40 and to invert the second drive voltage signal into the Nth-row data of previous-frame data relative to next-frame data and store the inverted second drive voltage signal in the previous-frame Nth-row data buffer module 10, and is further configured, when the switch module 50 is turned off, to be disconnected from the source driver module 40.

Figure 2:
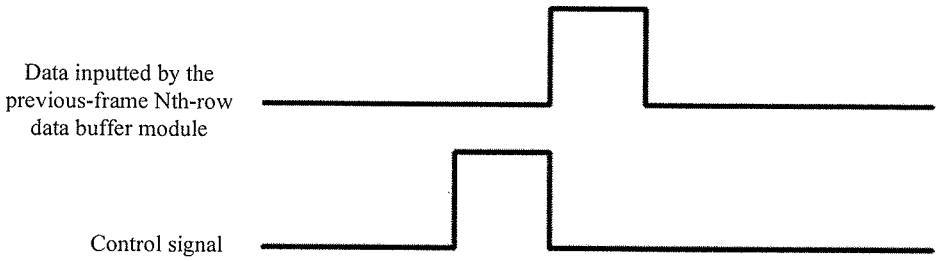
FIG. 2 is a diagram illustrating a comparison between a timing sequence of data inputted into a switch module and a timing sequence of data inputted into a current-frame Nth-row data buffer module according to an embodiment of the present disclosure.
Figure 3:
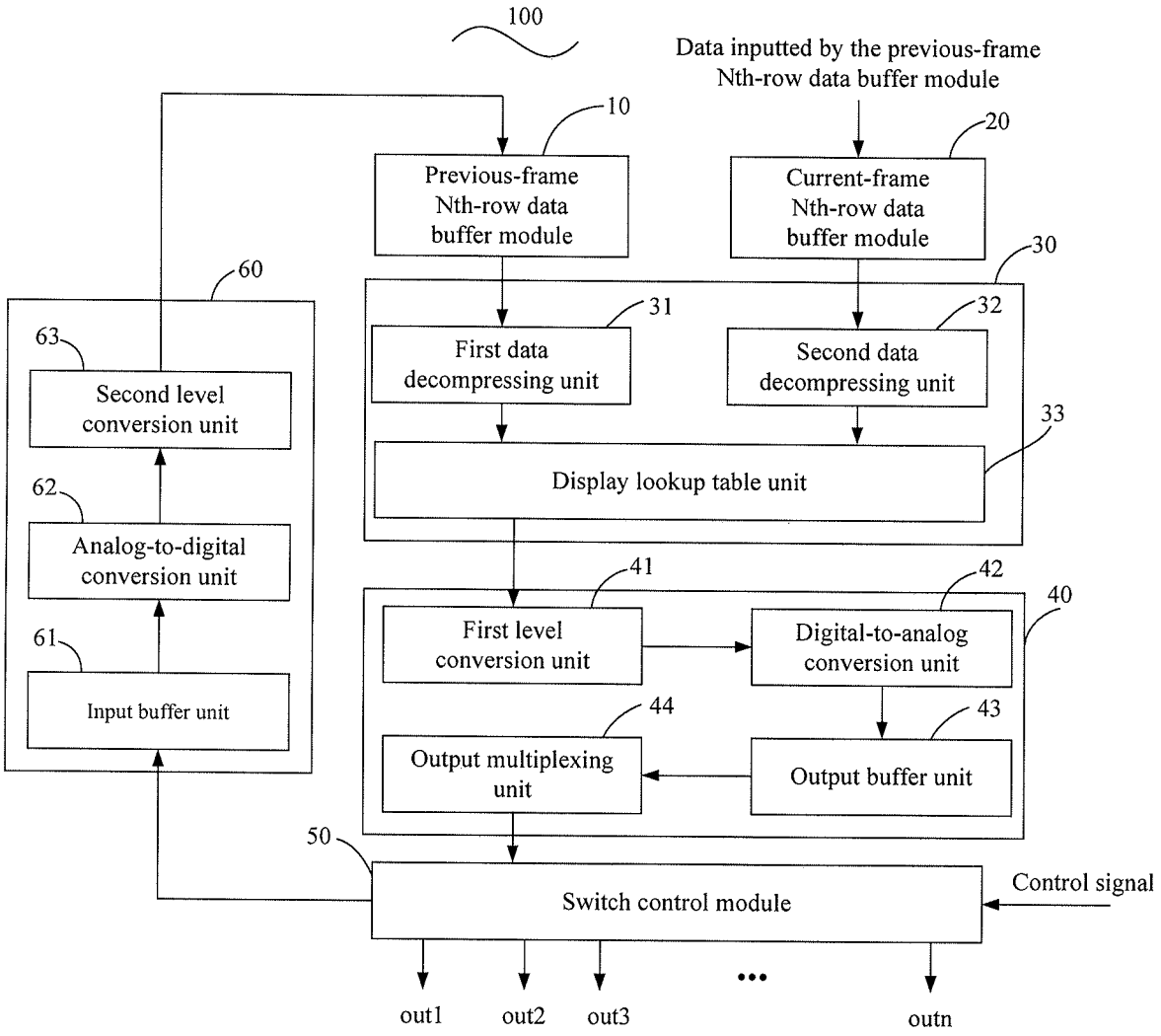
FIG. 3 is a schematic diagram of a driving circuit of a display panel according to another embodiment of the present disclosure.

By way of example, as illustrated in FIG. 2, an embodiment of the present disclosure illustrates a timing sequence diagram of a switch module 50 and a current-frame Nth-row data buffer module. In FIGS. 1 and 3, control signals (i.e., a first level signal (high level signal) and a second level signal (low level signal)) of the switch module 50 are denoted as TPX, and data inputted into the current-frame Nth-row data buffer module is denoted as TP. An Nth-row data is inputted into the current-frame Nth-row data buffer module at a high level, the switch module 50 connects the source driver module to the signal inverter module before the Nth-row data is inputted into the current-frame Nth-row data buffer module at a high level, so that the signal inverter module inverts the second drive voltage signal corresponding to the Nth-row data of previous-frame data into the Nth-row data of previous-frame data with respect to current-frame data. The over driving module finds corresponding drive data in the data lookup table based on the Nth-row data of previous-frame data and the Nth-row data of current-frame data, the source driver module processes the drive data into the first drive voltage signal of the current row, and then, when the switch module receives the low level signal, the first drive voltage signal of the current row is outputted to the display module to drive the display panel to display.

In the present embodiment, a drive voltage signal converted from the Nth-row data of current-frame data is inverted into an Nth-row data of previous-frame data relative to next-frame data and the Nth-row data of previous-frame data relative to next-frame data is cached, so that the Nth-row data of previous-frame data is cached without using a double-data-rate (DDR) synchronous dynamic random access memory and thus actual drive data is found in the table based on the Nth-row data of current-frame data and the Nth-row data of previous-frame data and the liquid crystal over driving function is achieved, effectively reducing the manufacturing cost of the timer control registers.

As illustrated in FIG. 3, in an embodiment of the present disclosure, the over driving module 30 in the embodiment corresponding to FIG. 1 includes a first data decompressing unit 31, a second data decompressing unit 32 and a display lookup table unit 33. The source driver module 40 includes a first level conversion unit 41, a digital-to-analog conversion unit 42, an output buffer unit 43 and an output multiplexing unit 44. The signal inverter module 60 includes an input buffer unit 61, an analog-to-digital conversion unit 62 and a second level conversion unit 63.

Connection relations and operating principles of the various units in the over driving module 30 are as follows.

The first data decompressing unit 31 is connected to the previous-frame Nth-row data buffer module 10 and is configured to read and decompress the Nth-row data of previous-frame data.

The first data decompressing unit 31 may be a software program in the over driving module 30 and is configured to implement a data decompressing function.

The second data decompressing unit 32 is connected to the current-frame Nth-row data buffer module 20 and is configured to read and decompress the Nth-row data of current-frame data.

The second data decompressing unit 32 may be a software program in the over driving module 30 and is configured to implement a data decompressing function.

In an embodiment, the first data decompression unit 31 and the second data decompressing unit 32 may be combined into a software program unit capable of simultaneously decompressing the Nth-row data of previous-frame data and the Nth-row data of current-frame data.

The display lookup table unit 33 is connected to the first data decompressing unit 31 and the second data decompressing unit 32 separately. The display lookup table unit 33 is configured to store a data lookup table, to search the data lookup table for corresponding drive data based on the decompressed Nth-row of current-frame data and Nth-row of previous-frame data and to output the corresponding drive data.

In the present embodiment, the display lookup table unit may be a display lookup table (LUT) or other data table or storage medium like random access memory (RAM) having an equal function.

Connection relations and operating principles of the various units in the source driver module 40 are as follows.

The first level conversion unit 41 is connected to the over driving module 30 and is configured to convert the level of the drive data so as to change a voltage magnitude of the drive data.

In practical use, the first level conversion unit 41 is configured to convert the voltage magnitude of the drive data into a voltage magnitude suitable for driving the display panel.

In the present embodiment, the first level conversion unit 41 may be a level converter or other component or circuit having an equal function. The specific type of the first level conversion is not particularly limited in the present embodiment.

The digital-to-analog conversion unit 42 is connected to the first level conversion unit 41 and is configured to perform digital-to-analog conversion for the drive data that has undergone level conversion to obtain the drive voltage signal.

In an embodiment, the digital-to-analog conversion unit 42 may be a digital-to-analog converter or other logic components having an equal function.

The output buffer unit 43 is connected to the digital-to-analog conversion unit 42 and is configured to buffer the drive voltage signal and to synchronously output all voltage data in the drive voltage signal to improve a drive capability of the drive voltage signal.

In the present embodiment, the output buffer unit 43 may be a buffer or other component having an equal function.

The output multiplexing unit 44 is connected to the output buffer unit 43 and is configured to process the drive voltage signal into a first drive voltage signal and a second drive voltage signal.

The output multiplexing unit 44 is configured to multiplex an inputted signal, that is, to obtain multiple output signals by duplicating, splitting or recombining the input signal.

Connection relations and operating principles of the various units in the signal inverter module 60 are as follows.

The input buffer unit 61 is connected to a switch module 50. The input buffer unit 61 is configured, when the switch module 50 is turned on, to be connected to the source driver module 40 and to cache the second drive voltage signal and to synchronously output all voltage data in the second drive voltage signal, and is further configured, when the switch module 50 is turned off, to be disconnected from the source driver module 40.

In an embodiment, the input buffer unit 61 may be a buffer or other component having an equal function. The input buffer unit 61 has a function same as the function of the output buffer unit.

The analog-to-digital conversion unit 62 is connected to the input buffer unit 61 and is configured to perform analog-to-digital conversion for the second drive voltage signal to obtain a digital signal.

In the embodiment, the analog-to-digital conversion unit 62 may be an analog-to-digital converter or other logic component having an equal function.

The second level conversion unit 63 is connected to the analog-to-digital conversion unit 62 and the previous-frame Nth-row data buffer module 10 separately and is configured to covert the level of the digital signal and store the digital signal that has undergone the level conversion in the previous-frame Nth-row data buffer module 10 to take the digital signal that has undergone level conversion as an Nth-row of previous-frame data relative to next-frame data.

In practical use, the second level conversion unit 63 is configured to restore a voltage magnitude of the drive data that has undergone analog-to-digital conversion to a voltage magnitude of the drive data that has not been converted by the first level conversion unit 41.

In an embodiment, the second level conversion unit 63 may be a level converter or other component or circuit structure having an equal function. The specific type of the second level conversion unit 63 is not particularly limited in the present embodiment.

In the present embodiment, the drive voltage signal is inverted so that the Nth-row data of previous-frame data relative to current-frame data can be cached. In this way, the liquid crystal over driving without the double-data-rate (DDR) synchronous dynamic random access memory is achieved.

Figure 4:
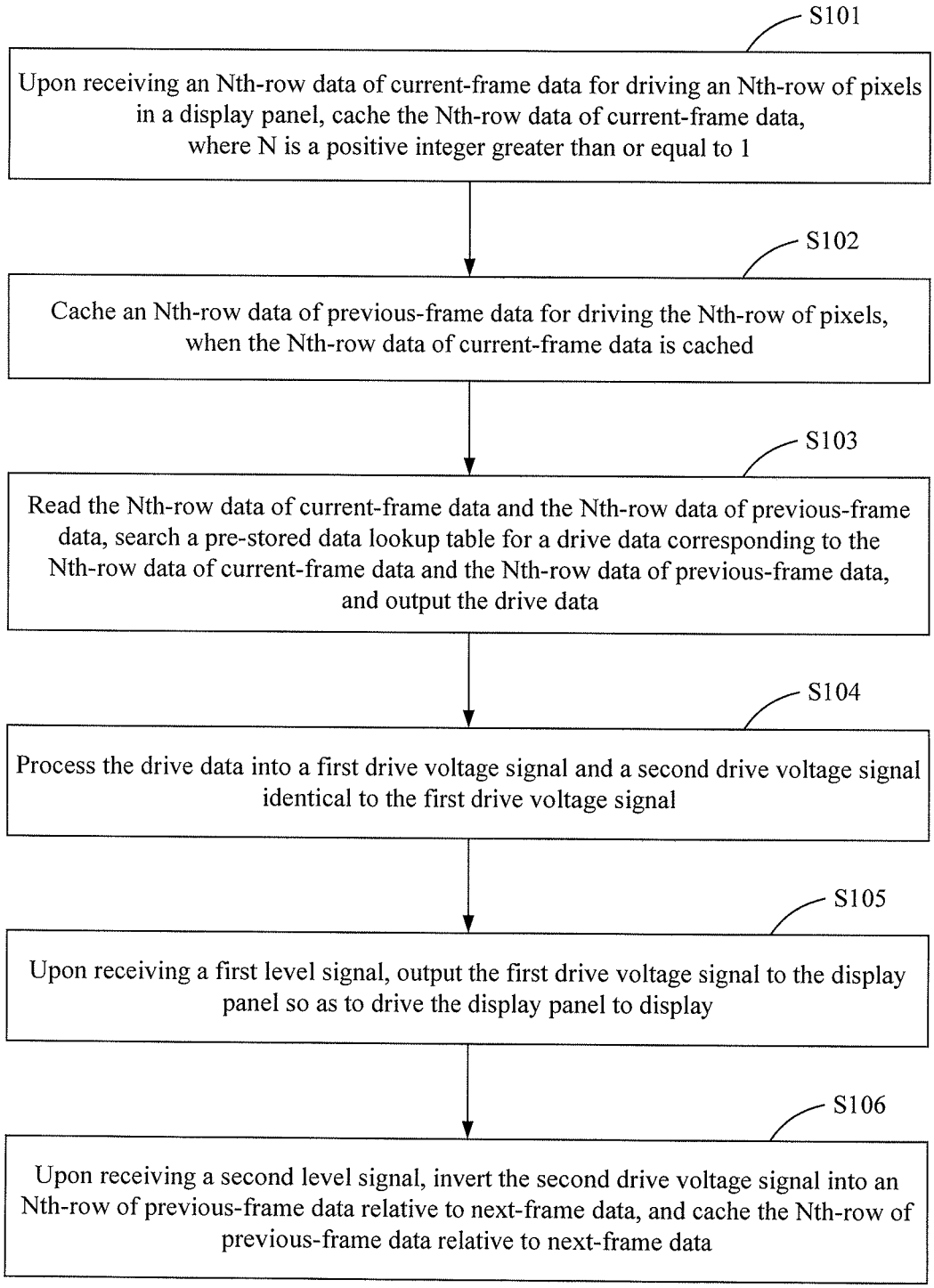
FIG. 4 is a flowchart of a driving method of a display panel according to an embodiment of the present disclosure.

As illustrated in FIG. 4, an embodiment of the present disclosure provides a driving method of a display panel including the following steps.

In step S101, upon receiving a Nth-row data of current-frame data, the Nth-row data of current-frame data is cached. The Nth-row data of current-frame data is used for driving an Nth-row of pixels in the display panel, where N is a positive integer greater than or equal to 1.

In step S102, an Nth-row data of previous-frame data for driving the Nth-row of pixels is cached when the Nth-row data of current-frame data is cached.

In step S103, the Nth-row data of current-frame data and the Nth-row data of previous-frame data are read, a pre-stored data lookup table is searched for a drive data corresponding to the Nth-row data of current-frame data and the Nth-row data of previous-frame data, and the drive data is outputted.

In step S104, the drive data is processed into a first drive voltage signal and a second drive voltage signal identical to the first drive voltage signal.

In step S105, when a first level signal is received, the first drive voltage signal is outputted to the display panel to drive the display panel to display.

In step S106, when a second level signal is received, the second drive voltage signal is inverted into an Nth-row data of previous-frame data relative to next-frame data and the Nth-row data of previous-frame data relative to next-frame data is cached.

In an embodiment, the above method may be executed by the driving circuit 100 in the preceding embodiments. The step S101 may be executed by the current-frame Nth-row data buffer module 20. The step S102 may be executed by the previous-frame Nth-row data buffer module 10. The step S103 may be executed by the over driving module 30. The steps S104 and S105 may be executed by the source driver module 40. The step S106 may be executed by the signal inverter module 60.

In the present embodiment, a drive voltage signal converted from the Nth-row data of current-frame data is inverted into the Nth-row data of previous-frame data relative to next-frame data and the Nth-row data of previous-frame data relative to next-frame data is cached, so that the Nth-row data of previous-frame data is cached without the double-data-rate (DDR) synchronous dynamic random access memory and thus the actual drive data is found in the table based on the Nth-row data of current-frame data and the Nth-row data of previous-frame data and the liquid crystal over driving function is achieved, effectively reducing the manufacturing cost of the timer control registers.

Figure 5:
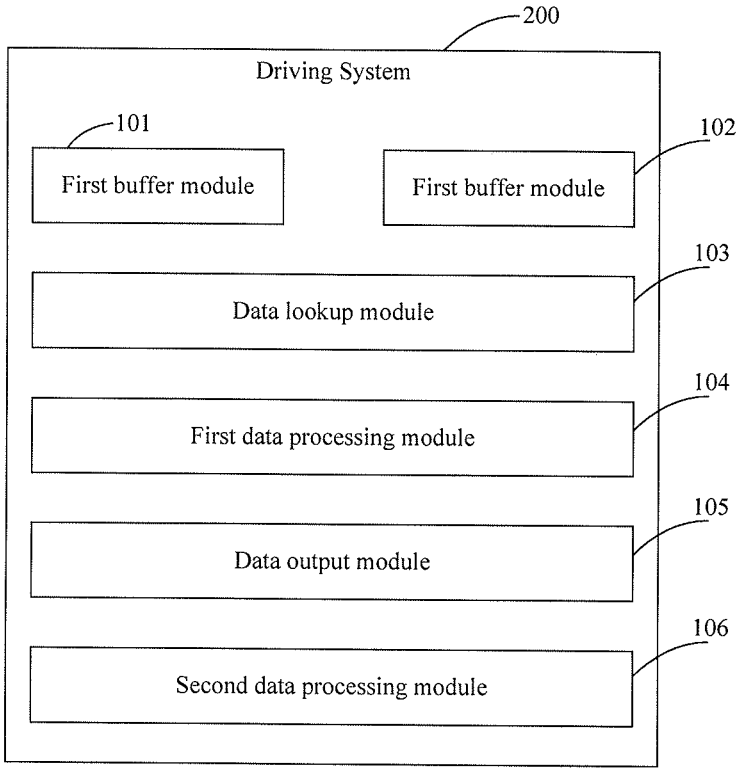
FIG. 5 is a structural block diagram of a driving system of a display panel according to an embodiment of the present disclosure.

As illustrated in FIG. 5, an embodiment of the present disclosure provides a driving system 200 for a display panel. The driving system 200 is configured to execute the steps in the embodiment corresponding to FIG. 4. The driving system 200 for the display panel includes a first buffer module 101, a second buffer module 102, a data lookup module 103, a first data processing module 104, a data output module 105 and a second data processing module 106.

The first buffer module 101 is configured to, upon receiving an Nth-row data of current-frame data for driving an Nth-row of pixels in the display panel, cache the Nth-row data of current-frame data, where N is a positive integer greater than or equal to 1.

The second buffer module 102 is configured to cache an Nth-row data of previous-frame data for driving the Nth-row of pixels when the Nth-row data of current-frame data is cached.

The data lookup module 103 is configured to read the Nth-row data of current-frame data and the Nth-row data of previous-frame data, search a pre-stored data lookup table for a drive data corresponding to the Nth-row data of current-frame data and the Nth-row data of previous-frame data, and output the drive data.

The first data processing module 104 is configured to process the drive data into a first drive voltage signal and a second drive voltage signal identical to the first drive voltage signal.

The data output module 105 is configured to, upon receiving the first level signal, output the first drive voltage signal to the display panel so as to drive the display panel to display.

The second data processing module 106 is configured, upon receiving the second level signal, to invert the second drive voltage signal into an Nth-row data of previous-frame data relative to next-frame data and to cache the Nth-row data of previous-frame data relative to next-frame data.

In an embodiment, the above system may be a software program system of the driving circuit 100 in the preceding embodiments. The first buffer module 101 may be a software program module in the current-frame Nth-row data buffer module 20. The second buffer module 102 may be a software program module in the previous-frame Nth-row data buffer module 10. The data lookup module 103 may be a software program module in the over driving module 30. The first data processing module 104 and the data output module 105 may be software program modules in the source driver module 40. The second data processing module 106 may be a software program module in the signal inverter module 60.

In the present embodiment, a drive voltage signal converted from the Nth-row data of current-frame data is inverted into the Nth-row data of previous-frame data relative to next-frame data and the Nth-row data of previous-frame data relative to next-frame data is cached, so that the Nth-row data of previous-frame data is cached without using the double-data-rate synchronous dynamic random access memory and thus actual drive data is found in the table based on the Nth-row data of current-frame data and the Nth-row data of previous-frame data and the liquid crystal over driving function is achieved, effectively reducing the manufacturing cost of the timer control register.

In an embodiment, all modules in the embodiment corresponding to FIG. 5 may be implemented by a general-purpose integrated circuit, e.g., a central processing unit (CPU) or by an application-specific integrated circuit (ASIC).

Figure 6:
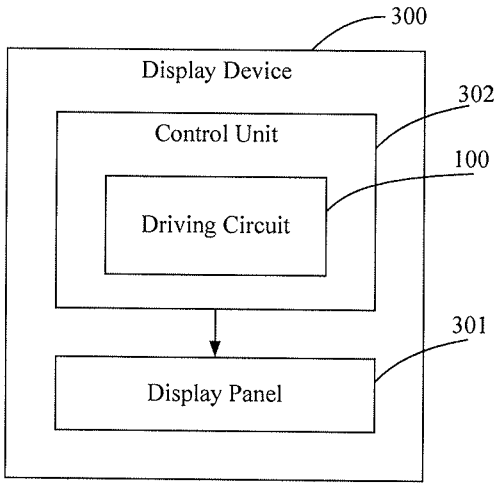
FIG. 6 is a structural block diagram of a display device according to an embodiment of the present disclosure.

As illustrated in FIG. 6, an embodiment of the present disclosure provides a display device 300. The display device 300 includes a display panel 301 and a control unit 302. The control unit 302 includes the driving circuit 100 in the preceding embodiments.

In an embodiment, the display device may be any type of display device provided with the above driving circuit 100, such as a liquid-crystal display (LCD) display device, an organic light-emitting diode (OLED) display device, a quantum-dot light-emitting diodes (QLED) display device or a curved display device.

In an embodiment, the display panel 301 includes a pixel array composed of multiple rows of pixels and multiple columns of pixels.

In an embodiment, the control unit 302 may be implemented by a general-purpose integrated circuit, e.g., a CPU or by an ASIC.

It will be understood by those of ordinary skill in the art that all or part of the procedure steps in the methods of the above embodiments may be implemented by related hardware instructed by computer programs, these programs may be stored in a computer-readable storage medium, and during the execution of these programs, the procedure steps in the above method embodiments may be implemented. The storage medium may be a magnetic disk, an optical disk, a read-only memory (ROM), a random access memory (RAM), or the like.

The above are only preferred embodiments of the present disclosure and are not intended to limit the present disclosure. Any modifications, equivalent substitutions, improvements and the like made within the spirit and principle of the present disclosure are within the scope of the present disclosure.

What is claimed is:

1. A driving circuit of a display panel, comprising:

a current-frame Nth-row data buffer module configured to, upon receiving an Nth-row data of current-frame data for driving an Nth-row of pixels in the display panel, cache the Nth-row data of current-frame data, wherein N is a positive integer greater than or equal to 1;

a previous-frame Nth-row data buffer module configured to cache an Nth-row data of previous-frame data for driving the Nth-row of pixels when the Nth-row data of current-frame data is cached;

an over driving module connected to the previous-frame Nth-row data buffer module and the current-frame Nth-row data buffer module and configured to read the Nth-row data of current-frame data and the Nth-row data of previous-frame data and to search a pre-stored data lookup table for a drive data corresponding to the Nth-row data of current-frame data and the Nth-row data of previous-frame data;

a source driver module connected to the over driving module and configured to obtain a first drive voltage signal and a second drive voltage signal identical to the first drive voltage signal based on the drive data;

a switch module connected to the source driver module and the display panel separately and configured to be turned on when receiving the first level signal and be turned off when receiving the second level signal and, when be turned off, to output the first drive voltage signal to the display panel so as to drive the display panel to display; and a signal inverter module connected to the switch module, wherein when the switch module is turned on, the signal inverter module is configured to be connected to the source driver module, invert the second drive voltage signal and store the inverted second drive voltage signal in the previous-frame Nth-row data buffer module, and when the switch module is turned off, the signal inverter module is further configured to be disconnected from the source driver module, wherein the signal inverter module comprises:

an input buffer unit connected to the switch module, wherein when the switch module is turned on, the input buffer unit is configured to be connected to the source driver module, cache the second drive voltage signal, and synchronously output all voltage data in the second drive voltage signal, and when the switch module is turned off, the input buffer unit is further configured to be disconnected from the source driver module;

an analog-to-digital conversion unit connected to the input buffer unit and configured to perform analog-to-digital conversion on the second drive voltage signal to obtain a digital signal; and a second level conversion unit connected to the analog-to-digital conversion unit and the previous-frame Nth-row data buffer module separately and is configured to perform level conversion on the digital signal, store the digital signal in the previous-frame Nth-row data buffer module, and take the digital signal that has undergone level conversion as an Nth-row of previous-frame data relative to next-frame data.

2. The driving circuit of a display panel according to claim 1, wherein the over driving module comprises:

a first data decompressing unit connected to the previous-frame Nth-row data buffer module and configured to read and decompress the Nth-row data of previous-frame data;

a second data decompressing unit connected to the current-frame Nth-row data buffer module and configured to read and decompress the Nth-row data of current-frame data; and a display lookup table unit connected to the first data decompressing unit and the second data decompressing unit separately, wherein the display lookup table unit is configured to prestore the data lookup table, to search the data lookup table for the corresponding drive data based on the decompressed Nth-row data of current-frame data and Nth-row data of previous-frame data, and to output the corresponding drive data.

3. The driving circuit of a display panel according to claim 2, wherein the display lookup table unit is a display lookup table.

4. The driving circuit of a display panel according to claim 1, wherein the source driver module comprises:

a first level conversion unit connected to the over driving module and configured to perform level conversion on the drive data to change a voltage magnitude of the drive data;

a digital-to-analog conversion unit, connected to the first level conversion unit and configured to perform digital-to-analog conversion on the drive data that has undergone level conversion to obtain a drive voltage signal;

an output buffer unit connected to the digital-to-analog conversion unit, wherein the output buffer unit is configured to: cache the drive voltage signal and synchronously output all voltage data in the drive voltage signal so as to improve a drive capability of the drive voltage signal; and an output multiplexing unit connected to the output buffer unit and configured to process the drive voltage signal into the first drive voltage signal and the second drive voltage signal.

5. The driving circuit of a display panel according to claim 1, wherein the first level signal is a high level signal and the second level signal is a low level signal.

6. The driving circuit of a display panel according to claim 1, wherein the switch module is an electronic switch tube.

7. The driving circuit of a display panel according to claim 1, wherein the current-frame Nth-row data buffer module is connected to an external timer/counter control register and is configured to be written one row data of current-frame data at a rising edge of an output signal of the timer control/counter register.

8. A display device, comprising a display panel and a control unit, wherein the control unit comprises a driving circuit, the driving circuit comprises:

a current-frame Nth-row data buffer module configured to, upon receiving an Nth-row data of current-frame data for driving an Nth-row of pixels in the display panel, cache the Nth-row data of current-frame data, wherein N is a positive integer greater than or equal to 1;

a previous-frame Nth-row data buffer module configured to cache an Nth-row data of previous-frame data for driving the Nth-row of pixels when the Nth-row data of current-frame data is cached;

an over driving module connected to the previous-frame Nth-row data buffer module and the current-frame Nth-row data buffer module and configured to: read the Nth-row data of current-frame data and the Nth-row data of previous-frame data, search a pre-stored data lookup table for a drive data corresponding to the Nth-row data of current-frame data and the Nth-row data of previous-frame data;

a source driver module connected to the over driving module and configured to obtain a first drive voltage signal and a second drive voltage signal identical to the first drive voltage signal based on the drive data;

a switch module connected to the source driver module and the display panel separately, wherein when receiving a first level signal, the switch module is configured to be turned on; when receiving a second level signal, the switch module is configured to be turned off; when the switch module is turned off, the switch module outputs the first drive voltage signal to the display panel so as to drive the display panel to display; and a signal inverter module connected to the switch module, wherein when the switch module is turned on, the signal inverter module is configured to be connected to the source driver module, invert the second drive voltage signal and store the inverted second drive voltage signal in the previous-frame Nth-row data buffer module; when the switch module is turned off, the signal inverter module is further configured to be disconnected from the source driver module, wherein the signal inverter module comprises:

an input buffer unit connected to the switch module, wherein when the switch module is turned on, the input buffer unit is configured to be connected to the source driver module, buffer the second drive voltage signal and synchronously output all voltage data in the second drive voltage signal; when the switch module is turned off, the input buffer unit is further configured to be disconnected from the source driver module;

an analog-to-digital conversion unit connected to the input buffer unit and configured to perform analog-to-digital conversion on the second drive voltage signal to obtain a digital signal; and a second level conversion unit connected to the analog-to-digital conversion unit and the previous-frame Nth-row data buffer module separately and configured to perform level conversion on the digital signal, store the digital signal in the previous-frame Nth-row data buffer module and take the digital signal that has undergone level conversion as an Nth-row of previous-frame data relative to next-frame data.

9. The display device according to claim 8, wherein the over driving module comprises:

a first data decompressing unit connected to the previous-frame Nth-row data buffer module and configured to read and decompress the Nth-row data of previous-frame data;

a second data decompressing unit connected to the current-frame Nth-row data buffer module and configured to read and decompress the Nth-row data of current-frame data; and a display lookup table unit connected to the first data decompressing unit and the second data decompressing unit separately, wherein the display lookup table unit is configured to: prestore the data lookup table, search the data lookup table for the corresponding drive data based on the decompressed Nth-row data of current-frame data and Nth-row data of previous-frame data and output the corresponding drive data.

10. The display device according to claim 9, wherein the display lookup table unit is a display lookup table.

11. The display device according to claim 8, wherein the source driver module comprises:

a first level conversion unit connected to the over driving module and configured to perform level conversion on the drive data so as to change a voltage magnitude of the drive data;

a digital-to-analog converter unit connected to the first level converter unit and configured to perform digital-to-analog conversion on the drive data that has undergone level conversion so as to obtain a drive voltage signal;

an output buffer unit connected to the digital-to-analog converter unit and configured to cache the drive voltage signal and synchronously output all voltage data in the drive voltage signal so as to improve a drive capability of the drive voltage signal; and an output multiplexing unit connected to the output buffer unit and configured to process the drive voltage signal into the first drive voltage signal and the second drive voltage signal.

12. The display device according to claim 8, wherein the first level signal is a high level signal and the second level signal is a low level signal.

13. The display device according to claim 8, wherein the switch module is an electronic switch tube.

14. The display device according to claim 8, wherein the current-frame Nth-row data buffer module is connected to an external timer/counter control register and is configured to be written one row data of current-frame data at a rising edge of an output signal of the timer/counter control register.

15. The display device according to claim 8, wherein the display panel comprises m*n pixels arranged in m rows and n columns, the switch module comprises n output terminals, and each of the n output terminals is connected to a respective one of the n columns of pixels.

16. The display device according to claim 15, wherein the switch module further comprises an (n+1)th output terminal connected to the signal inverter module.

17. The display device according to claim 16, wherein the switch module further comprises an input terminal connected to the source driver module and a control terminal for receiving a control signal.

* * * * *